US009168741B2

(12) United States Patent
Goden et al.

(10) Patent No.: US 9,168,741 B2
(45) Date of Patent: Oct. 27, 2015

(54) SUBSTRATE FOR LIQUID EJECTING HEAD, LIQUID EJECTING HEAD, AND RECORDING APPARATUS

(71) Applicant: CANON KABUSHIKI KAISHA, Tokyo (JP)

(72) Inventors: Tatsuhito Goden, Machida (JP); Yasuo Fujii, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/467,887

(22) Filed: Aug. 25, 2014

(65) Prior Publication Data

US 2015/0062251 A1 Mar. 5, 2015

(30) Foreign Application Priority Data

Aug. 27, 2013 (JP) ..... 2013-175725

(51) Int. Cl.
*B41J 29/38* (2006.01)
*B41J 2/14* (2006.01)
*B41J 2/045* (2006.01)

(52) U.S. Cl.
CPC ..... *B41J 2/14072* (2013.01); *B41J 2/04528* (2013.01); *B41J 2/04563* (2013.01); *B41J 2/04565* (2013.01)

(58) Field of Classification Search
CPC ..... B41J 2/14072; B41J 2/04528; B41J 2/04563; B41J 2/04565
USPC ..... 347/17, 19, 14, 58
See application file for complete search history.

(56) References Cited

U.S. PATENT DOCUMENTS

| | | | | |
|---|---|---|---|---|
| 4,539,571 | A * | 9/1985 | Suzuki | 347/185 |
| 4,899,180 | A * | 2/1990 | Elhatem et al. | 347/59 |
| 4,980,702 | A * | 12/1990 | Kneezel et al. | 347/17 |
| 5,191,360 | A * | 3/1993 | Pohlig | 347/17 |
| 5,880,753 | A * | 3/1999 | Ikeda et al. | 347/17 |
| 6,074,034 | A * | 6/2000 | Maeda | 347/17 |
| 6,357,863 | B1 * | 3/2002 | Anderson et al. | 347/58 |
| 6,382,773 | B1 * | 5/2002 | Chang et al. | 347/57 |

FOREIGN PATENT DOCUMENTS

JP 2010-076441 A 4/2010

* cited by examiner

*Primary Examiner* — Henok Legessse
(74) *Attorney, Agent, or Firm* — Canon U.S.A., Inc. IP Division

(57) ABSTRACT

A substrate for a liquid ejecting head according to an exemplary embodiment of the present invention includes a first area having a plurality of ejection heaters and a driving circuit that is configured to supply electric energy to the plurality of ejection heaters disposed thereon, a second area having a signal supplying circuit that is configured to supply an electric signal to the driving circuit disposed thereon, and a heater that is configured to heat the substrate and that includes a first portion disposed in the first area and a second portion disposed in the second area. The magnitude of a current supplied to the first portion differs from the magnitude of a current supplied to the second portion.

23 Claims, 6 Drawing Sheets

SUBSTRATE FOR LIQUID EJECTING HEAD, LIQUID EJECTING HEAD, AND RECORDING APPARATUS

BACKGROUND OF THE INVENTION

1. Field of the Invention

Techniques disclosed in the present specification relate to substrates for liquid ejecting heads, liquid ejecting heads, and recording apparatuses.

2. Description of the Related Art

Thermal type liquid ejecting heads are used in recording apparatuses that carry out recording by ejecting liquid, such as ink, onto a recording medium. Japanese Patent Laid-Open No. 2010-076441 discloses a thermal type liquid ejecting head that includes a substrate having an ejection heater disposed thereon, a conductive wire that supplies a current to the ejection heater, and a sub-heater that is electrically separated from the conductive wire. Furthermore, Japanese Patent Laid-Open No. 2010-076441 discloses a feature in which the sub-heater is formed by a conductive member and the substrate is heated by supplying a current to the conductive member. Through such a configuration, a situation in which a temperature distribution is generated in the substrate included in the liquid ejecting head can be suppressed.

SUMMARY OF THE INVENTION

A substrate for a liquid ejecting head according to an exemplary embodiment of an aspect of the present invention includes a first area having a plurality of ejection heaters and a driving circuit that is configured to supply electric energy to the plurality of ejection heaters disposed thereon, a second area having a signal supplying circuit that is configured to supply an electric signal to the driving circuit disposed thereon, and a heater that is configured to heat the substrate and that includes a first portion disposed in the first area and a second portion disposed in the second area. A magnitude of a current supplied to the first portion differs from a magnitude of a current supplied to the second portion.

A substrate for a liquid ejecting head according to an exemplary embodiment of another aspect of the present invention includes a first area having a plurality of ejection heaters and a driving circuit that is configured to supply electric energy to the plurality of ejection heaters disposed thereon, a second area having a signal supplying circuit that is configured to supply an electric signal to the driving circuit disposed thereon, and a heater that is configured to heat the substrate and that includes a first portion disposed in the first area and a second portion disposed in the second area. A heat generation quantity of the first portion per unit area differs from a heat generation quantity of the second portion per unit area.

A recording apparatus according to an exemplary embodiment of yet another aspect of the present invention includes a substrate for a liquid ejection head and a controlling unit. The substrate for the liquid ejecting head includes a first area having a plurality of ejection heaters and a driving circuit that is configured to supply electric energy to the plurality of ejection heaters disposed thereon, a second area having a signal supplying circuit that is configured to supply an electric signal to the driving circuit disposed thereon, and a heater that is configured to heat the substrate and that includes a first portion disposed in the first area and a second portion disposed in the second area. The controlling unit controls at least one of a current supplied to the first portion and a current supplied to the second portion independently from the other one of the current supplied to the first portion and the current supplied to the second portion.

Further features of the present invention will become apparent from the following description of exemplary embodiments with reference to the attached drawings.

DESCRIPTION OF THE EMBODIMENTS

Figure 1:
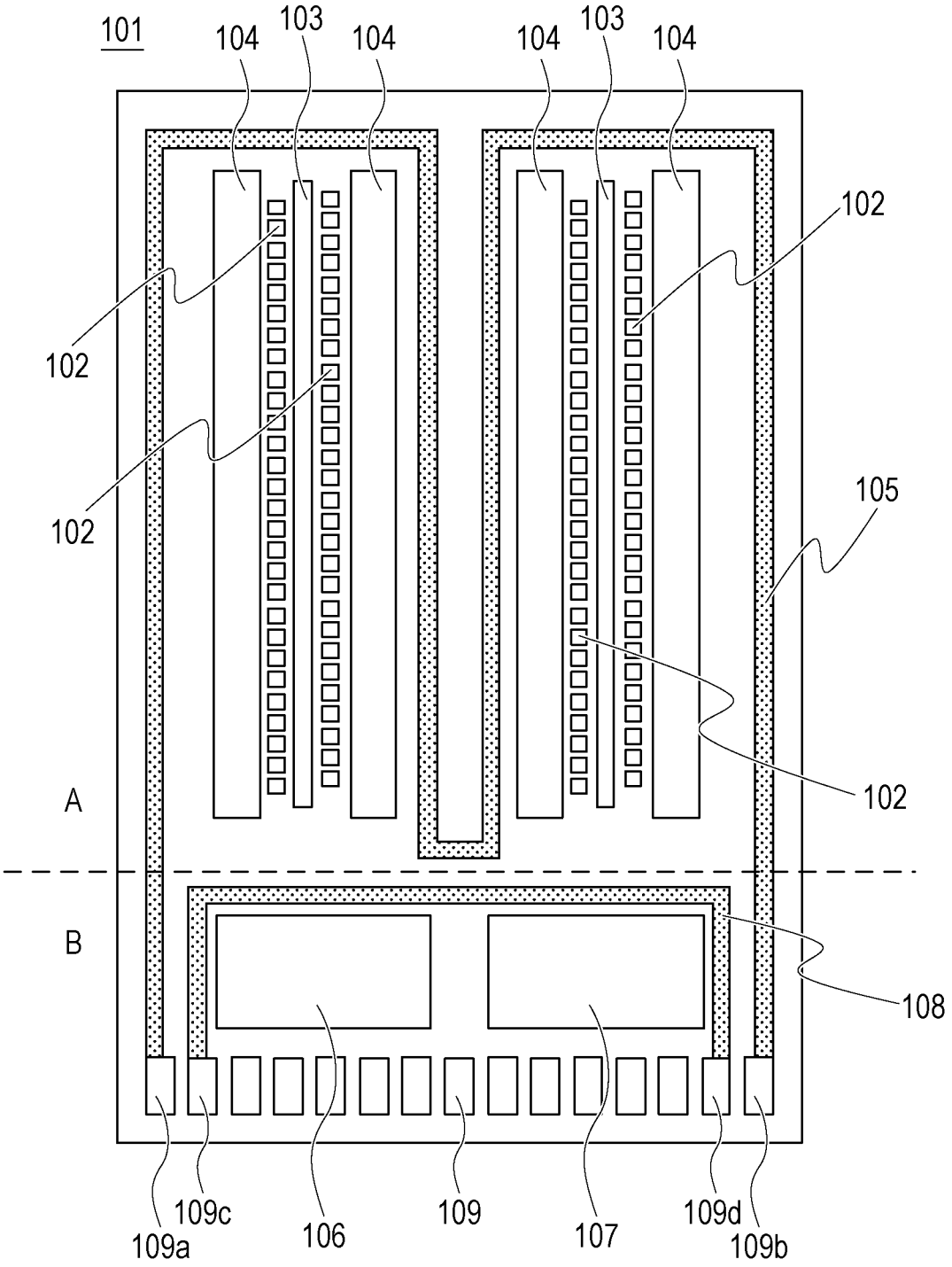
FIG. 1 schematically illustrates a planar configuration of a substrate for a liquid ejecting head.

According to some exemplary embodiments of the present invention, a temperature of a substrate for a liquid ejecting head can be controlled in accordance with a location on the substrate.

In the liquid ejecting head disclosed in Japanese Patent Laid-Open No. 2010-076441, the conductive member of the sub-heater is disposed so as to form a single current path across the entire substrate. When a current is supplied to such a conductive member, the entire substrate can be heated substantially uniformly.

With the sub-heater described in Japanese Patent Laid-Open No. 2010-076441, however, it is difficult to locally heat a portion of the substrate or to vary a heat generation quantity of the sub-heater in accordance with a location on the substrate. Thus, for example, there is a situation in which a temperature distribution generated in the substrate cannot be suppressed at a sufficient level if the heat generation quantity during operation differs depending on the location on the substrate. In addition, it is difficult to set the temperatures of a plurality of portions on the substrate to temperatures that are appropriate for the respective portions.

In the light of such problems, the present inventors disclose a technique that makes it possible to control the temperature of a substrate for a liquid ejecting head in accordance with a location on the substrate.

An exemplary embodiment according to the present invention relates to a substrate for a liquid ejecting head that includes an element for ejecting liquid, such as ink. Another exemplary embodiment of the present invention relates to a liquid ejecting head that includes a substrate for the liquid ejecting head and an ink supplying unit configured to supply recording ink to the substrate for the liquid ejecting head. The liquid ejecting head, for example, is a recording head for a recording apparatus. Yet another exemplary embodiment of the present invention relates to a recording apparatus that includes a liquid ejecting head and a driving unit configured to drive the liquid ejecting head. The recording apparatus, for example, is a printer or a copier. Alternatively, a liquid ejecting head according to an exemplary embodiment of the present invention can be employed in an apparatus to be used to manufacture a DNA chip, an organic transistor, a color filter, or the like.

A plurality of ejection heaters are provided on the substrate for the liquid ejecting head. Driving circuits are disposed on the substrate for the liquid ejecting head in correspondence with the plurality of ejection heaters. A single driving circuit may be provided for each of the ejection heaters. Alternatively, a single driving circuit may be provided for a group of ejection heaters. Each of the driving circuits supplies electric energy to a plurality of ejection heaters. The driving circuits each include, for example, a transistor connected to ejection heaters, and supply a current to the ejection heaters through the transistor. Upon the current being supplied to the ejection heaters, the ejection heaters radiate heat, and liquid can thus be ejected. In addition to the transistor connected to the ejection heaters, the driving circuits may each include and a buffer or a level shifter connected to the transistor. The plurality of ejection heaters and the driving circuits are disposed in a first area of the substrate for the liquid ejecting head.

A signal supplying circuit configured to supply an electric signal to the driving circuits is disposed on the substrate for the liquid ejecting head. An electric signal to be supplied from the signal supplying circuit, for example, is a power supply voltage of the driving circuits or a control signal of the driving circuits. A control signal of the driving circuits may be generated on the basis of externally supplied information. In such a case, the signal supplying circuit includes a signal processing circuit configured to process such externally supplied information. In addition, the signal supplying circuit may include a voltage generating circuit configured to generate, from an externally supplied first power supply voltage, a second power supply voltage that is distinct from the first power supply voltage. The signal supplying circuit is disposed in a second area of the substrate for the liquid ejecting head.

As described above, in addition to the ejection heaters, a plurality of circuits, such as the driving circuits for driving the ejection heaters and the signal supplying circuit, is mounted on the substrate for the liquid ejecting head. It is possible that the heat generation quantity during operation differs among these circuits. Alternatively, the temperature suitable for an operation may differ among these circuits. For example, as the temperature of the ejection heaters is higher, the liquid ejection performance improves. Therefore, it is preferable to operate the ejection heaters at a higher temperature. In the meantime, the electrical characteristics of the signal supplying circuit improves as the temperature thereof is lower. However, in a case in which the temperature of the signal supplying circuit is too low, the signal supplying circuit becomes more likely to break due to thermal expansion of a material forming the wiring. Therefore, it is preferable to operate the signal supplying circuit within a predetermined temperature range.

A substrate heater (hereinafter, referred to as a sub-heater) configured to preliminarily heat the substrate for the liquid ejecting head is provided on the substrate for the liquid ejecting head. The sub-heater includes a first portion disposed in the first area and a second portion disposed in the second area. The magnitude of the current supplied to the first portion differs from the magnitude of the current supplied to the second portion. At least one of the currents supplied to the first portion and the second portion may be controlled. In addition, the first portion and the second portion may each form an independent current path.

Such a configuration enables the heat generation quantity of the sub-heater to differ between the first area and the second area. Specifically, as the magnitude of the current flowing in the first portion of the sub-heater differs from the magnitude of the current flowing in the second portion of the sub-heater, the heat generation quantity can be made to differ between the first area and the second area. Thus, the temperature can be controlled in accordance with the location on the substrate for the liquid ejecting head. For example, even in a case in which the heat generation quantity during operation differs between the first area and the second area, a temperature distribution generated in the substrate for the liquid ejecting head can be suppressed. Alternatively, a temperature distribution can be prevented from being generated in the substrate for the liquid ejecting head. As another alternative, a temperature distribution in the substrate for the liquid ejecting head can be increased so that each portion of the substrate for the liquid ejecting head can operate at an optimal temperature.

As a specific example, an increase in the operating frequency of the signal processing circuit leads to an increase in power consumption, and the heat generation quantity of the signal processing circuit tends to increase accordingly. Thus, the temperature of the substrate tends to become higher in an area close to the signal processing circuit as compared to an area spaced apart from the signal processing circuit. Therefore, the magnitude of the current supplied to the second portion of the sub-heater is set to be smaller than the magnitude of the current supplied to the first portion of the sub-heater. Through this, while the first area is being heated preliminarily, the heat generation quantity of the sub-heater in the second area, where the signal processing circuit is disposed, can be set to zero, or can be set to be smaller than the heat generation quantity of the sub-heater in the first area. As a result, a temperature distribution generated in the substrate can be suppressed. It should be noted that the heat generation quantity of the sub-heater in the second area can be set to zero if a current is not supplied to the second portion of the sub-heater. A situation in which a current is not supplied to the second portion of the sub-heater corresponds to a case in which the magnitude of the current supplied to the second portion is zero, or in other words, the magnitude of the supplied current is minimum.

The heat generation quantity of the signal processing circuit is large in some cases or is small in some other cases. Thus, a difference between the temperature of the substrate at an area close to the signal processing circuit and the temperature of the substrate at an area spaced apart from the signal processing circuit is not constant. Therefore, a temperature distribution in the substrate can be suppressed efficiently in accordance with an operation status by controlling at least one of the currents to be supplied to the first portion and the second portion of the sub-heater. As each of the first portion and the second portion of the sub-heater forms an independent current path, at least one of the currents to be supplied to the first portion and the second portion can be controlled.

As another example, there is a case in which the heat generation quantity of the ejection heaters disposed in the first area is greater than the heat generation quantity of the signal supplying circuit disposed in the second area. In such a case, the magnitude of the current supplied to the first portion of the sub-heater is set to be greater than the magnitude of the current supplied to the second portion of the sub-heater. Through this, the ejection heaters operate at a higher temperature, and the ejection performance can thus be improved. In addition, the operating temperature of the signal supplying circuit can also be made higher, and thus the reliability of the substrate for the liquid ejecting head can be enhanced while maintaining the electrical characteristics of the signal supplying circuit.

First Exemplary Embodiment

A first exemplary embodiment will be described. FIG. 1 schematically illustrates a planar configuration of a substrate 101 for a liquid ejecting head. A liquid ejecting head to be used as a recording head of a recording apparatus includes the substrate 101 for the liquid ejecting head and a nozzle forming member (not illustrated) provided on the substrate 101 for the liquid ejecting head. A plurality of nozzles (not illustrated) for ejecting ink are formed in the nozzle forming member.

The substrate 101 for the liquid ejecting head includes a first area (hereinafter, an area A) and a second area (hereinafter, an area B). The broken line illustrated in FIG. 1 indicates the boundary between the area A and the area B for descriptive purposes. In FIG. 1, the area A and the area B of the substrate 101 for the liquid ejecting head are adjacent to each other in a direction in which a plurality of ejection heaters 102 are arrayed in each heater array, or in other words, in a direction in which the long side of the substrate 101 for the liquid ejecting head extends. Alternatively, the area A and the area B may be adjacent to each other in a direction intersecting the direction in which the ejection heaters 102 are arrayed, or in other words, in a direction in which the short side of the substrate 101 for the liquid ejecting head extends.

The plurality of ejection heaters 102 are disposed in the area A of the substrate 101 for the liquid ejecting head. The plurality of ejection heaters 102 are disposed so as to form four heater arrays. The direction in which the plurality of ejection heaters 102 are arrayed in each of the heater arrays coincides with the direction in which the long side of the substrate 101 for the liquid ejecting head extends. In addition, the four heater arrays are arranged in a direction in which the short side of the substrate 101 for the liquid ejecting head extends. Although four heater arrays are disposed in FIG. 1, the number of heater arrays may be modified as appropriate in accordance with the type of ink. In the liquid ejecting head, a plurality of nozzles are formed at positions corresponding to the respective ejection heaters 102. Supply ports 103 through which ink is supplied to the ejection heaters 102 are formed so as to penetrate the substrate 101 for the liquid ejecting head. A plurality of supply ports 103 are provided so that a single supply port 103 is assigned to two heater arrays.

In addition, heater driving circuits 104 are disposed in the area A of the substrate 101 for the liquid ejecting head. Four heater driving circuits 104 are disposed in correspondence with the respective heater arrays each formed of a plurality of ejection heaters 102, and the heater driving circuits 104 drive the ejection heaters 102. Each of the heater driving circuits 104 is disposed in an area across a corresponding heater array of the ejection heaters 102 from a supply port 103.

The heater driving circuits 104 are configured to supply electric energy to the ejection heaters 102. Although not illustrated in FIG. 1, the heater driving circuits 104 of the first exemplary embodiment each include a transistor connected to the ejection heaters 102 and a buffer connected to the transistor. Currents are supplied to the ejection heaters 102 in accordance with a control signal supplied to the transistor through the buffer. The heater driving circuits 104 may each include a level shifter, in place of the buffer.

An ink ejection operation in the substrate 101 for the liquid ejecting head according to the first exemplary embodiment will now be described. Ink is supplied to the ejection heaters 102 through the supply ports 103 from the rear side of the substrate 101 for the liquid ejecting head. Selected ejection heaters 102 are then heated by the heater driving circuits 104. Through this, bubbles are produced in the ink on the ejection heaters 102, and the ink is thus ejected through the nozzles.

A signal supplying circuit that supplies an electric signal to the heater driving circuits 104 is disposed in the area B of the substrate 101 for the liquid ejecting head. The signal supplying circuit according to the first exemplary embodiment includes at least a signal processing circuit 106 and a voltage generating circuit 107.

The signal processing circuit 106 processes image information and control information transmitted from a recording apparatus (not illustrated) and supplies a control signal to the heater driving circuits 104. The control signal is supplied through signal lines connecting the signal processing circuit 106 with the respective heater driving circuits 104. The heater driving circuits 104 selectively drive the plurality of ejection heaters 102 in accordance with the control signal. The signal processing circuit 106 includes a shift register circuit, a latch circuit, a logic gate, and so on.

The voltage generating circuit 107 shifts the level of an externally inputted power supply voltage so as to generate a power supply voltage to be supplied to the heater driving circuits 104. The power supply voltage is supplied through the power supply lines connecting the voltage generating circuit 107 with the respective heater driving circuits 104. Here, instead of providing the voltage generating circuit 107, the externally inputted power supply voltage may be supplied directly to the heater driving circuits 104.

Furthermore, a plurality of pad electrodes 109 for connecting to the recording apparatus are disposed in the area B of the substrate 101 for the liquid ejecting head. For example, a power supply voltage for supplying electric energy to the ejection heaters 102, a power supply voltage for driving each of the circuits, image information, control information, and so on are inputted through the pad electrodes 109. In addition, a power source voltage of the sub-heater, which will be described later, is inputted through the pad electrodes 109.

The substrate 101 for the liquid ejecting head is typically quadrangular in shape. In the first exemplary embodiment, the plurality of pad electrodes 109 are disposed at one of the four sides of the substrate 101 for the liquid ejecting head. Alternatively, the plurality of pad electrodes 109 may be distributed so as to be disposed at one side and a side opposite to the stated one side of the substrate 101 for the liquid ejecting head.

A sub-heater (a first portion 105 and a second portion 108 illustrated in FIG. 1) for heating the substrate 101 for the liquid ejecting head is disposed on the substrate 101 for the liquid ejecting head according to the first exemplary embodiment. The sub-heater includes the first portion 105 and the second portion 108. The sub-heater is formed of a conductive member, such as gold, copper, aluminum, and polysilicon. The conductive member included in the sub-heater is electrically separated from power supply lines for supplying electric energy to the ejection heaters 102. The conductive member included in the sub-heater is electrically separated from power supply lines and signal lines connected to the heater driving circuits 104. The conductive member included in the sub-heater is electrically separated from a power supply line and a signal line connected to the signal supplying circuit.

The power supply lines and the signal lines connected to the heater driving circuits 104 are disposed in a first wiring layer. The power supply line and the signal line connected to the signal supplying circuit are disposed in the first wiring layer. The power supply lines for supplying electric energy to the ejection heaters 102 are disposed in a second wiring layer. The conductive member forming the sub-heater is disposed in the first wiring layer or in the second wiring layer. For example, the first portion 105 of the sub-heater may be formed only by the conductive member included in the first wiring layer or the conductive member included in the second wiring layer. The second portion 108 of the sub-heater may be formed only by the conductive member included in the first wiring layer or the conductive member included in the second wiring layer. Alternatively, each of the first portion 105 and the second portion 108 of the sub-heater may include the conductive member in the first wiring layer and the conductive member in the second wiring layer. In a case in which the sub-heater includes the conductive members in a plurality of wiring layers, the conductive member in the first wiring layer and the conductive member in the second wiring layer are interconnected through a plug provided in an interlayer insulating film.

The first portion 105 and the second portion 108 each form an independent current path. In the first exemplary embodiment, the current flowing in the first portion 105 of the sub-heater and the current flowing in the second portion 108 of the sub-heater are controlled independently from each other. In other words, even when one of the currents flowing in the first portion 105 and the second portion 108 is changed, the other one of the currents does not change. Alternatively, the currents flowing in the first portion 105 and the second portion 108 change in such a manner that a ratio of an amount of change in the current flowing in the first portion 105 to an amount of change in the current flowing in the second portion 108 varies. Thus, the currents can be controlled in such a manner that the magnitude of the current supplied to the first portion 105 differs from the magnitude of the current supplied to the second portion 108. For example, control may be carried out such that a current is supplied to only one of the first portion 105 and the second portion 108 and a current is not supplied to the other one of the first portion 105 and the second portion 108. A situation in which a current is not supplied to the first portion 105 or to the second portion 108 of the sub-heater corresponds to a case in which the magnitude of the current supplied to the first portion 105 or to the second portion 108 is zero, or in other words, the magnitude of the supplied current is minimum.

It should be noted that in a modification of the first exemplary embodiment, the current flowing in the first portion 105 of the sub-heater and the current flowing in the second portion 108 of the sub-heater are not controlled independently from each other. In such a case, the current flowing in the first portion 105 of the sub-heater and the current flowing in the second portion 108 of the sub-heater may be controlled in such a manner that a ratio of an amount of change in the current flowing in the first portion 105 to an amount of change in the current flowing in the second portion 108 stays constant.

The first portion 105 of the sub-heater is disposed in the area A of the substrate 101 for the liquid ejecting head, or in other words, in the vicinity of the area where the ejection heaters 102 and the heater driving circuits 104 are disposed. Through this configuration, the temperature of the area A can be raised.

The second portion 108 of the sub-heater is disposed in the area B of the substrate 101 for the liquid ejecting head, or in other words, in the vicinity of the area where the signal processing circuit 106 and the voltage generating circuit 107 are disposed. Through this configuration, the temperature of the area B can be raised.

The signal processing circuit 106 disposed in the area B processes image information and control information transmitted from the recording apparatus. An increase in the amount of information to be processed by the signal processing circuit 106 leads to an increase in power consumption of the signal processing circuit 106, and the heat generation quantity of the signal processing circuit 106 increases accordingly. Meanwhile, when the amount of information to be processed by the signal processing circuit 106 decreases, the heat generation quantity of the signal processing circuit 106 decreases accordingly. In other words, the heat generation quantity varies in accordance with the operation status of the signal processing circuit 106. Therefore, the heat generation quantity of the substrate 101 for the liquid ejecting head varies in accordance with the location on the substrate 101. In particular, the heat radiated from the signal processing circuit 106 has a large influence on the ejection heaters 102 disposed close to the area B.

Thus, by driving the first portion 105 of the sub-heater disposed in the area A and the second portion 108 of the sub-heater disposed in the area B independently from each other, occurrence of a temperature distribution in the substrate 101 for the liquid ejecting head can be suppressed.

In controlling the second portion 108 of the sub-heater, the magnitude of the current supplied to the second portion 108 of the sub-heater is set to zero when the heat generation quantity of the signal processing circuit 106 is large. Alternatively, the magnitude of the current supplied to the second portion 108 of the sub-heater is set to be smaller than the magnitude of the current supplied to the first portion 105 of the sub-heater. On the other hand, the magnitude of the current supplied to the first portion 105 of the sub-heater is set to zero when the heat generation quantity of the signal processing circuit 106 is small. Alternatively, the magnitude of the current supplied to the second portion 108 of the sub-heater is set to be greater than the magnitude of the current supplied to the first portion 105 of the sub-heater. Through such control, a temperature distribution in the substrate 101 for the liquid ejecting head can be reduced. For example, a difference between the temperature of the area A and the temperature of the area B present when the currents are controlled as described above can be smaller than a difference between the temperature of the area A and the temperature of the area B present when the substrate 101 for the liquid ejecting head is operated without any power being supplied to the sub-heater. Alternatively, with the use of the sub-heater, a difference between the temperature of the area A and the temperature of the area B can be made to fall within a predetermined range of, for example, 50° C.

The sub-heater can be controlled by controlling the magnitude of the voltage to be applied. Alternatively, the sub-heater can be controlled by controlling the magnitude of the current with the use of a variable resistor. As another alternative, the sub-heater can be controlled by controlling the duration in which a voltage is applied or a current is supplied. Some or all of the magnitude of the voltage to be applied, the magnitude of the current, and duration in which the voltage is applied or the current is supplied may be controlled.

A case in which the second portion 108 of the sub-heater is controlled in response to the heat radiation of the signal processing circuit 106 has been described. Even in a case in which the voltage generating circuit 107 radiates heat or in a case in which a functional circuit required to drive another heater is disposed in the area B, the occurrence of a temperature distribution can be suppressed in a similar manner by controlling the second portion 108 of the sub-heater.

As illustrated in FIG. 1, in the first exemplary embodiment, the first portion 105 of the sub-heater connects a first pad electrode 109*a* and a second pad electrode 109*b* to each other. The second portion 108 of the sub-heater connects a third pad electrode 109*c* and a fourth pad electrode 109*d* to each other. These pad electrodes 109 are connected to the liquid ejecting head, the recording apparatus, and so on. Even in a case in which the substrate 101 for the liquid ejecting head according to the first exemplary embodiment is mounted on the liquid ejecting head or the recording apparatus, the first portion 105 and the second portion 108 of the sub-heater are not included within a single current path. For example, power supply voltages are inputted to the first and third pad electrodes 109*a* and 109*c* and the second and fourth pad electrodes 109*b* and 109*d* are grounded, and thus the first portion 105 and the second portion 108 can each form an independent current path. The voltages to be inputted to the pad electrodes 109, however, are not limited to the aforementioned example. Any two voltages that differ from each other may be inputted.

In the first exemplary embodiment, the first portion 105 of the sub-heater connects the two pad electrodes 109*a* and 109*b* disposed at one side of the substrate 101 for the liquid ejecting head. Alternatively, the first portion 105 of the sub-heater may connect a pad electrode disposed at one side of the substrate 101 for the liquid ejecting head to another pad electrode disposed at a side opposite to the stated one side.

In addition, in the first exemplary embodiment, the first portion 105 of the sub-heater is disposed in a meandering manner. Specifically, the current flowing in the first portion 105 changes direction at two or more locations. Such a configuration makes it possible to heat the entire area A of the substrate 101 for the liquid ejecting head substantially uniformly. As a result, the recording quality can be improved.

Second Exemplary Embodiment

Another exemplary embodiment will be described. A second exemplary embodiment differs from the first exemplary embodiment in that a substrate for a liquid ejecting head includes a temperature sensor. Hereinafter, only the features that differ from those of the first exemplary embodiment will be described, and descriptions of the features that are identical to those of the first exemplary embodiment will be omitted.

Figure 2:
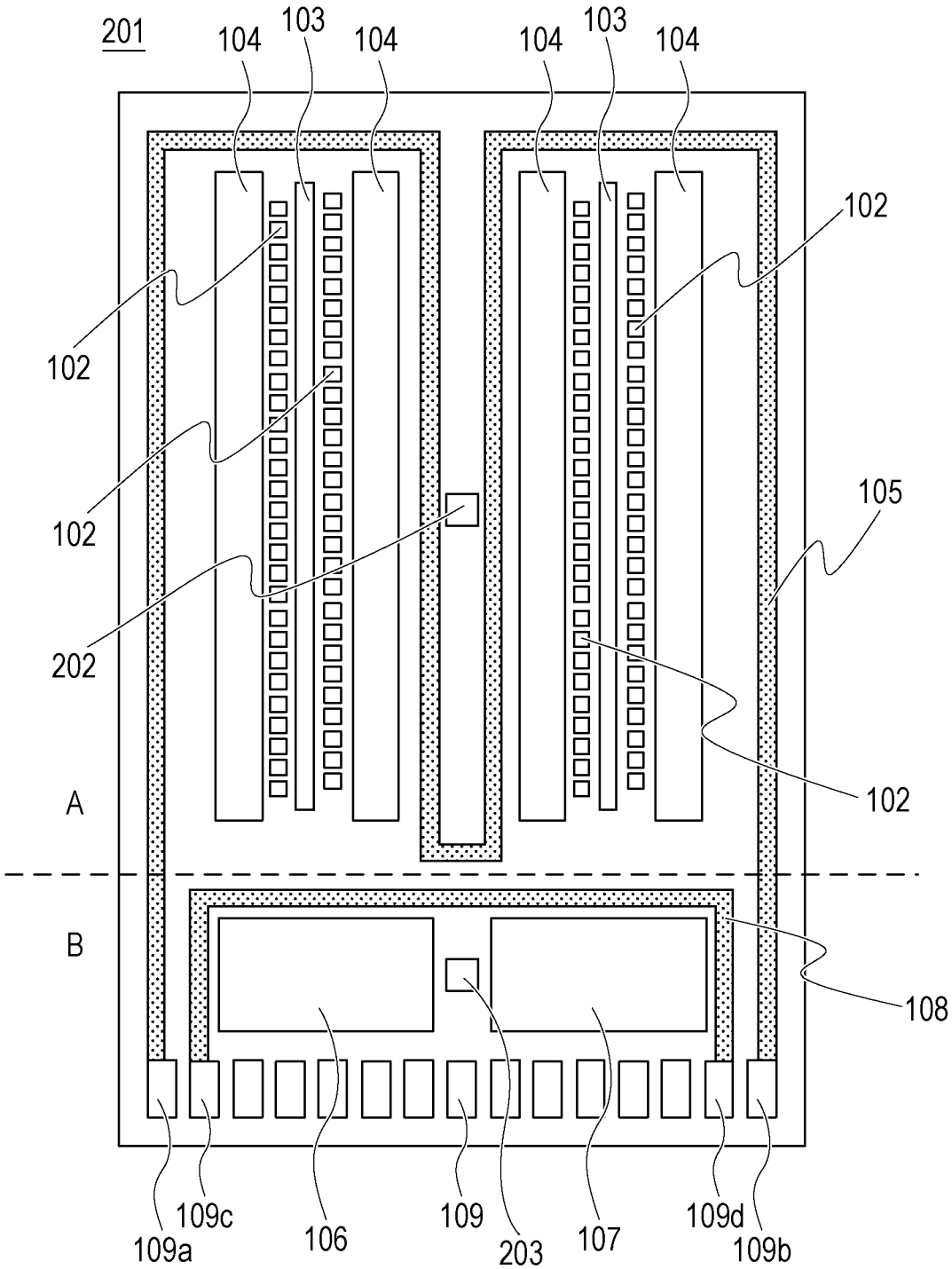
FIG. 2 schematically illustrates a planar configuration of a substrate for a liquid ejecting head.

FIG. 2 schematically illustrates a planar configuration of a substrate 201 for a liquid ejecting head. A component having a function identical to that of a corresponding component of the first exemplary embodiment is given an identical reference character, and detailed descriptions thereof will be omitted.

A first temperature sensor 202 and a second temperature sensor 203 are disposed on the substrate 201 for the liquid ejecting head. The first temperature sensor 202 is disposed in the area A of the substrate 201 for the liquid ejecting head. The first temperature sensor 202 measures the temperature of the area A of the substrate 201 for the liquid ejecting head. The second temperature sensor 203 is disposed in the area B of the substrate 201 for the liquid ejecting head. The second temperature sensor 203 measures the temperature of the area B of the substrate 201 for the liquid ejecting head. A temperature sensor of which electrical characteristics vary in accordance with the temperature thereof, such as a diode and a resistor, may be used as the temperature sensors 202 and 203.

Information on the temperatures detected by the first and second temperature sensors 202 and 203 is converted to an electric signal, and the electric signal is then inputted to an external controlling unit through a pad electrode 109. The controlling unit is included, for example, in the recording apparatus. Alternatively, information on the temperatures detected by the first and second temperature sensors 202 and 203 is converted to an electric signal, and the electric signal is then inputted to the signal processing circuit 106.

The current supplied to the first portion 105 of the sub-heater and the current supplied to the second portion 108 of the sub-heater are controlled in accordance with the temperature information outputted from the first and second temperature sensors 202 and 203. The signal processing circuit 106 included in the substrate 201 for the liquid ejecting head may control the currents. Alternatively, the controlling unit included in the recording apparatus may control the currents.

As an exemplary controlling method, the detected temperature of the area A and the detected temperature of the area B are each compared with a predetermined reference temperature. If one of the detected temperatures is lower than the reference temperature, a current is supplied to a corresponding one of the first portion 105 and the second portion 108 of the sub-heater. If the temperature of the area A and the temperature of the area B are both lower than the reference temperature, currents may be supplied to both the first portion 105 and the second portion 108 of the sub-heater. Meanwhile, if one of the detected temperatures is higher than the reference temperature, a corresponding one of the first portion 105 and the second portion 108 of the sub-heater is stopped. If the temperature of the area A and the temperature of the area B are both higher than the reference temperature, the first portion 105 and the second portion 108 of the sub-heater may both be stopped.

A reference temperature for the area A may differ from a reference temperature for the area B. In addition, in a case in which the temperature of the area A differs from the temperature of the area B, the current supplied to the sub-heater may be controlled so that the temperature difference increases.

As another exemplary controlling method, the detected temperature of the area A is compared with the detected temperature of the area B. Then, a current is supplied to one of the first portion 105 and the second portion 108 of the sub-heater which is disposed in an area with a lower temperature, and a current is not supplied to the other one of the first portion 105 and the second portion 108. Alternatively, the current supplied to one of the first portion 105 and the second portion 108 disposed in an area with a lower temperature is set to be greater than the current supplied to the other one of the first portion 105 and the second portion 108. A difference between the current supplied to the first portion 105 and the current supplied to the second portion 108 may be varied in accordance with a difference between the temperature of the area A and the temperature of the area B.

As described thus far, the substrate 201 for the liquid ejecting head according to the second exemplary embodiment includes the temperature sensors 202 and 203. Such a configuration makes it possible to control the temperature of the substrate 201 for the liquid ejecting head in accordance with the location on the substrate 201 with higher precision.

Third Exemplary Embodiment

Another exemplary embodiment will be described. A third exemplary embodiment differs from the first exemplary embodiment in that a first portion and a second portion of the sub-heater are connected to each other. Hereinafter, only the features that differ from those of the first exemplary embodiment will be described, and descriptions of the features that are identical to those of the first exemplary embodiment will be omitted.

Figure 3:
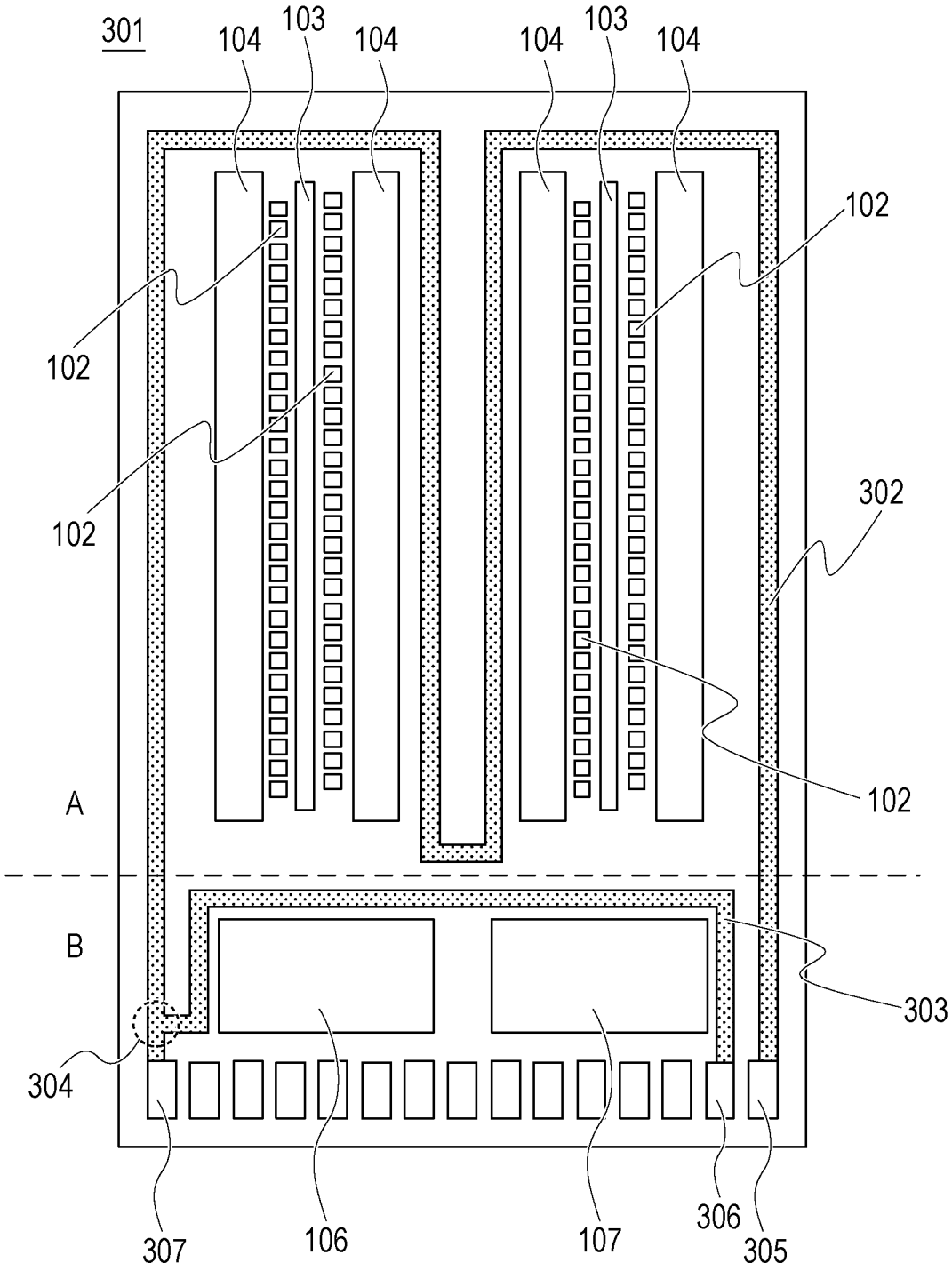
FIG. 3 schematically illustrates a planar configuration of a substrate for a liquid ejecting head.

FIG. 3 schematically illustrates a planar configuration of a substrate 301 for a liquid ejecting head. A component having a function identical to that of a corresponding component of the first exemplary embodiment is given an identical reference character, and detailed descriptions thereof will be omitted.

The sub-heater according to the third exemplary embodiment includes a first portion 302 and a second portion 303. The first portion 302 is disposed in the area A of the substrate 301 for the liquid ejecting head. The second portion 303 is disposed in the area B of the substrate 301 for the liquid ejecting head. In addition, the sub-heater includes a connecting portion 304 that connects the first portion 302 with the second portion 303. The first portion 302 of the sub-heater connects the connecting portion 304 with a first pad electrode 305. The second portion 303 of the sub-heater connects the connecting portion 304 with a second pad electrode 306. The sub-heater further includes a third portion that connects the connecting portion 304 with a third pad electrode 307.

Here, wiring resistance of the third portion is lower than wiring resistance of the first portion 302 and wiring resistance of the second portion 303. For example, in a case in which the width and the thickness of the conductive member forming the sub-heater are constant, the length of the third portion is shorter than the length of the first portion 302 and the length of the second portion 303.

The first portion 302 and the second portion 303 each form an independent current path. In the third exemplary embodiment, the current flowing in the first portion 302 of the sub-heater and the current flowing in the second portion 303 of the sub-heater are controlled independently from each other. The currents flowing in the first portion 302 and the second portion 303 change in such a manner that a ratio of an amount of change in the current flowing in the first portion 302 to an amount of change in the current flowing in the second portion 303 varies. Thus, the currents can be controlled in such a manner that the magnitude of the current supplied to the first portion 302 differs from the magnitude of the current supplied to the second portion 303.

In the third exemplary embodiment, the above-described control of the currents is implemented through voltages to be inputted to the first, second, and third pad electrodes 305, 306, and 307. For example, a power supply voltage is inputted to the first pad electrode 305, and the second and third pad electrodes 306 and 307 are grounded. Through this, a current can be supplied selectively to the first portion 302 of the sub-heater. The resistance of the third portion of the sub-heater is smaller than the resistance of the second portion 303, and thus most of the current generated through a voltage across the connecting portion 304 and the second pad electrode 306 and a voltage across the connecting portion 304 and the third pad electrode 307 is supplied to the third portion. Therefore, a current does not flow or flows in an extremely small amount between the connecting portion 304 and the second pad electrode 306, or in other words, through the second portion 303.

In addition, a power supply voltage is inputted to the second pad electrode 306, and the first and third pad electrodes 305 and 307 are grounded. Through this, a current can be supplied selectively to the second portion 303 of the sub-heater. The resistance of the third portion of the sub-heater is smaller than the resistance of the first portion 302, and thus most of the current generated through a voltage across the connecting portion 304 and the first pad electrode 305 and a voltage across the connecting portion 304 and the third pad electrode 307 is supplied to the third portion. Therefore, the current does not flow or flows in an extremely small amount between the connecting portion 304 and the first pad electrode 305, or in other words, through the first portion 302.

Furthermore, power supply voltages are inputted to the first and second pad electrodes 305 and 306, and the third pad electrode 307 is grounded. Through this, currents can be supplied to both the first portion 302 and the second portion 303.

In the above-described example, a case in which a power supply voltage is inputted to some of the pad electrodes and the remaining pad electrodes are grounded has been described. The voltages to be inputted to the pad electrodes, however, are not limited to the above example. Any two voltages that differ from each other may be inputted.

In FIG. 3, the first, second, and third pad electrodes 305, 306, and 307 are all disposed at one side of the substrate 301 for the liquid ejecting head. Alternatively, the first pad electrode 305 may be disposed at a side of the substrate 301 for the liquid ejecting head which is opposite to the stated one side.

In addition, the substrate 301 for the liquid ejecting head may include temperature sensors as described in the second exemplary embodiment. In such a case, the currents are controlled in a manner similar to the second exemplary embodiment.

As described thus far, in the third exemplary embodiment, the first portion 302 and the second portion 303 of the sub-heater are connected to each other. Even in a case in which the two portions of the sub-heater are connected to each other, the currents can be controlled independently from each other by controlling the applied voltages. Through such a configuration, the number of pad electrodes can be reduced. As a result, the size of the substrate for the liquid ejecting head can be reduced.

Fourth Exemplary Embodiment

Another exemplary embodiment will be described. A fourth exemplary embodiment differs from the first exemplary embodiment in that a connecting unit that controls an electrical connection between a first portion and a second portion of a sub-heater is provided. Hereinafter, only the features that differ from those of the first exemplary embodiment will be described, and descriptions of the features that are identical to those of the first exemplary embodiment will be omitted.

Figure 4:
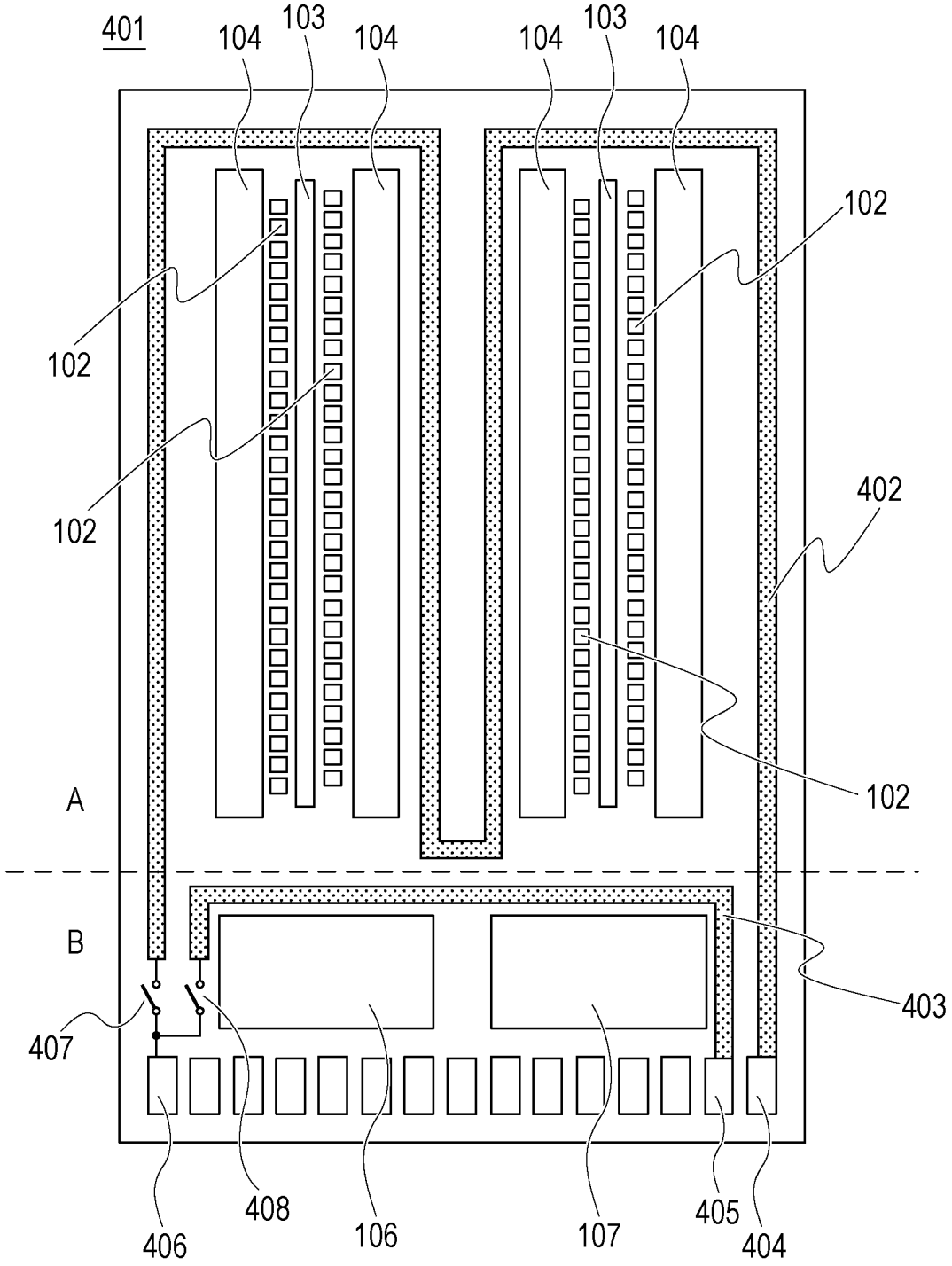
FIG. 4 schematically illustrates a planar configuration of a substrate for a liquid ejecting head.

FIG. 4 schematically illustrates a planar configuration of a substrate 401 for a liquid ejecting head. A component having a function identical to that of a corresponding component of the first exemplary embodiment is given an identical reference character, and detailed descriptions thereof will be omitted.

A first portion 402 of the sub-heater is disposed in the area A of the substrate 401 for the liquid ejecting head. A second portion 403 of the sub-heater is disposed in the area B of the substrate 401 for the liquid ejecting head. The first portion 402 of the sub-heater connects a switch 407 with a first pad electrode 404. The second portion 403 of the sub-heater connects a switch 408 with a second pad electrode 405. The first portion 402 and the second portion 403 of the sub-heater are electrically interconnected through the two switches 407 and 408. The two switches 407 and 408 correspond to the connecting unit that controls the electrical connection between the first portion 402 and the second portion 403. A MOS transistor or a bipolar transistor is used as the switches 407 and 408. The sub-heater further includes a third portion that connects the two switches 407 and 408 with a third pad electrode 406.

In the fourth exemplary embodiment, power supply voltages are inputted to the first pad electrode 404 and the second pad electrode 405, and the third pad electrode 406 is grounded. As the switch 407 is turned on in this state, a current can be supplied to the first portion 402 of the sub-heater. In addition, as the switch 408 is turned on, a current can be supplied to the second portion 403 of the sub-heater. Thus, the currents can be controlled in such a manner that the magnitude of the current supplied to the first portion 402 differs from the magnitude of the current supplied to the second portion 403.

The signal processing circuit 106 may, for example, supply a control signal for controlling the switches 407 and 408. Alternatively, a control signal for controlling the switches 407 and 408 may be supplied externally. In such a case, the controlling unit of the recording apparatus supplies the control signal for controlling the switches 407 and 408.

In the above-described example, a case in which a power supply voltage is inputted to some of the pad electrodes and the remaining pad electrodes are grounded has been described. The voltages to be inputted to the pad electrodes, however, are not limited to the above example. Any two voltages that differ from each other may be inputted.

In FIG. 4, the first, second, and third pad electrodes 404, 405, and 406 are all disposed at one side of the substrate 401 for the liquid ejecting head. Alternatively, the first pad electrode 404 may be disposed at a side of the substrate 401 for the liquid ejecting head which is opposite to the stated one side.

In addition, the substrate 401 for the liquid ejecting head may include temperature sensors as described in the second exemplary embodiment. In such a case, the currents are controlled in a manner similar to the second exemplary embodiment.

As described thus far, the substrate 401 for the liquid ejecting head according to the fourth exemplary embodiment includes the connecting unit that controls the electrical connection between the first portion 402 and the second portion 403 of the sub-heater. Thus, the currents to be supplied to the two portions of the sub-heater can be controlled independently from each other with the use of the connecting unit. Through such a configuration, the number of pad electrodes can be reduced. As a result, the size of the substrate for the liquid ejecting head can be reduced.

In addition, in the fourth exemplary embodiment, the first pad electrode 404 and the second pad electrode 405 may be served by a common pad electrode. Through such a configuration, the number of pad electrodes can be further reduced. As a result, the size of the substrate for the liquid ejecting head can be reduced.

Fifth Exemplary Embodiment

Another exemplary embodiment will be described. A fifth exemplary embodiment differs from the first exemplary embodiment in terms of a layout of a signal supplying circuit. Hereinafter, only the features that differ from those of the first exemplary embodiment will be described, and descriptions of the features that are identical to those of the first exemplary embodiment will be omitted.

Figure 5:
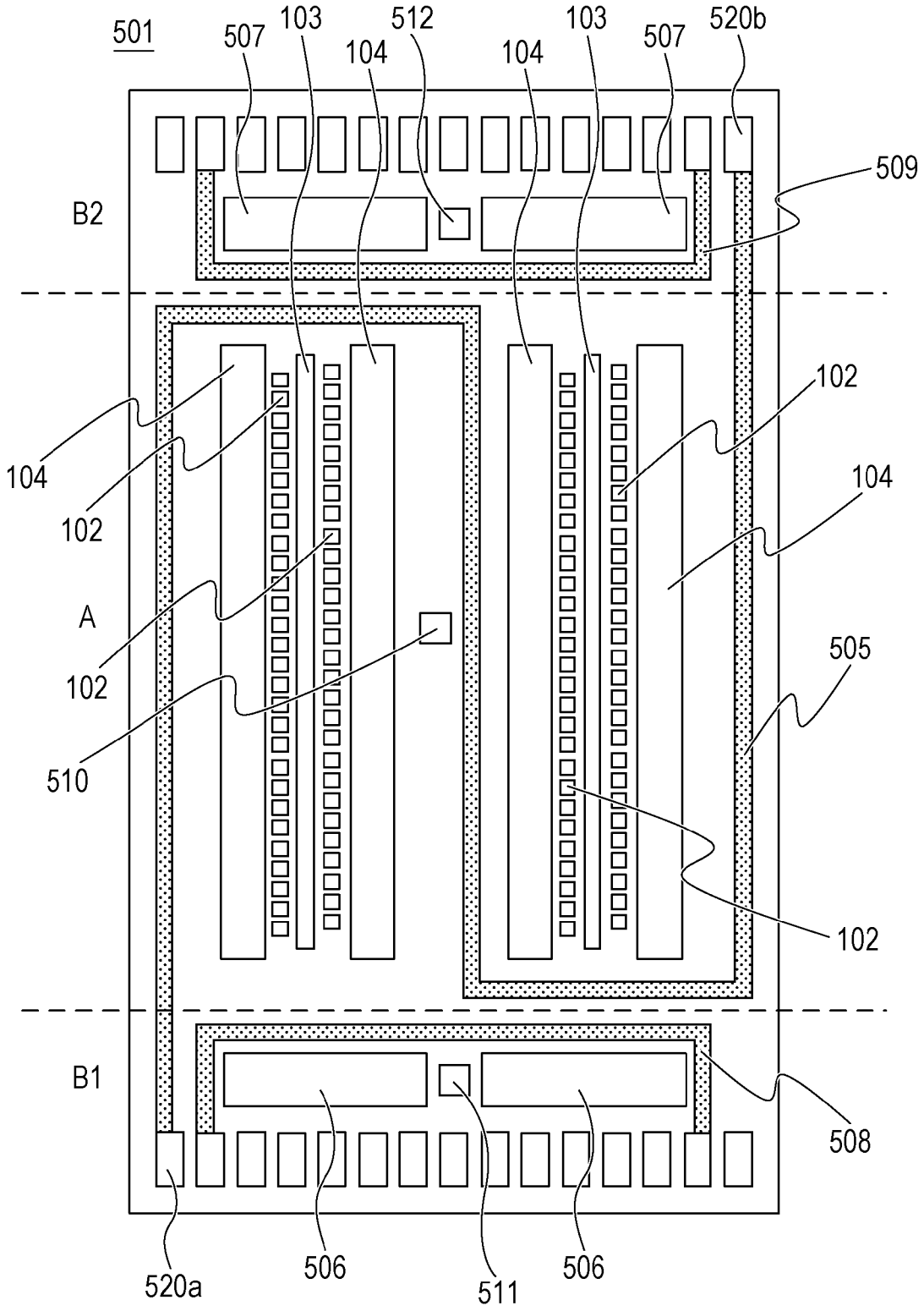
FIG. 5 schematically illustrates a planar configuration of a substrate for a liquid ejecting head.

FIG. 5 schematically illustrates a planar configuration of a substrate 501 for a liquid ejecting head. A component having a function identical to that of a corresponding component of the first exemplary embodiment is given an identical reference character, and detailed descriptions thereof will be omitted.

The substrate 501 for the liquid ejecting head includes a first area (hereinafter, an area A) and a second area. In the fifth exemplary embodiment, the second area includes two areas B1 and B2. The area A is located between the area B1 and the area B2. The area B1, the area A, and the area B2 are arranged in a direction in which the long side of the substrate 501 for the liquid ejecting head extends.

A signal supplying circuit that supplies electric signals to the heater driving circuits 104 is disposed in the second area of the substrate 501 for the liquid ejecting head. The signal supplying circuit according to the fifth exemplary embodiment includes at least signal processing circuits 506 and voltage generating circuits 507. The functions of the signal processing circuits 506 and the voltage generating circuits 507 are identical to those of the signal processing circuit 106 and the voltage generating circuit 107, respectively, of the first exemplary embodiment.

In the fifth exemplary embodiment, the signal processing circuits 506 are disposed in the area B1. The voltage generating circuits 507 are disposed in the area B2. In addition, a plurality of pad electrodes 520 for connecting to the recording apparatus are disposed in each of the area B1 and the area B2 of the substrate 501 for the liquid ejecting head.

A sub-heater (a first portion 505 and second portions 508 and 509 illustrated in FIG. 5) for heating the substrate 501 for the liquid ejecting head is disposed on the substrate 501 for the liquid ejecting heat according to the fifth exemplary embodiment. The sub-heater includes the first portion 505 and the two second portions 508 and 509. Each of the first portion 505, the second portion 508, and the second portion 509 of the sub-heater forms an independent current path. In the fifth exemplary embodiment, the current flowing in the first portion 505 of the sub-heater, the current flowing in the second portion 508 of the sub-heater, and the current flowing in the second portion 509 of the sub-heater are controlled independently from one another.

The first portion 505 of the sub-heater is disposed in the area A of the substrate 501 for the liquid ejecting head, or in other words, in the vicinity of the area where the ejection heaters 102 and the heater driving circuits 104 are disposed. Through this configuration, the temperature of the area A can be raised.

The second portion 508 of the sub-heater is disposed in the area B1 of the substrate 501 for the liquid ejecting head, or in other words, in the vicinity of the area where the signal processing circuits 506 are disposed. Through this configuration, the temperature of the area B1 can be raised.

The second portion 509 of the sub-heater is disposed in the area B2 of the substrate 501 for the liquid ejecting head, or in other words, in the vicinity of the area where the voltage generating circuits 507 are disposed. Through this configuration, the temperature of the area B2 can be raised.

The first portion 505 of the sub-heater connects a first pad electrode 520*a* with a second pad electrode 520*b*. The first pad electrode 520*a* is disposed in the area B1. Meanwhile, the second pad electrode 520*b* is disposed in the area B2. It should be noted that the first portion 505 of the sub-heater according to the fifth exemplary embodiment may be laid out in a manner similar to that of the first portion 105 of the sub-heater according to the first exemplary embodiment. Specifically, the first portion 505 of the sub-heater may be disposed so as to connect two pad electrodes disposed in one of the area B1 and the area B2.

The second portion 508 of the sub-heater connects two pad electrodes disposed in the area B1. The second portion 509 of the sub-heater connects two pad electrodes disposed in the area B2.

As described in the first exemplary embodiment, the heat generation quantity varies in accordance with the operation status of the signal processing circuits 506. Therefore, the heat generation quantity of the substrate 501 for the liquid ejecting head differs depending on the location on the substrate 501. In particular, an influence of heat radiated from the signal processing circuits 506 is large on the ejection heaters 102 disposed close to the area B1.

Thus, by driving the first portion 505 of the sub-heater disposed in the area A and the second portion 508 of the sub-heater disposed in the area B1 independently from each other, occurrence of a temperature distribution in the substrate 501 for the liquid ejecting head can be suppressed.

In addition, heat radiated from the voltage generating circuits 507 disposed in the area B2 also influences the ejection heaters 102 disposed close to the area B2. Typically, the heat generation quantity of the voltage generating circuits 507 differs from the heat generation quantity of the signal processing circuits 506. Therefore, the temperature within the area A may differ between a portion close to the area B1 and a portion close to the area B2.

Thus, the second portions 508 and 509 of the sub-heater are controlled independently from each other so that the difference between the temperature of the area B1 and the temperature of the area B2 is reduced or is eliminated. For example, if the heat generation quantity of the signal processing circuits 506 is greater than the heat generation quantity of the voltage generating circuits 507, heating by the second portion 508 of the sub-heater is not carried out. Alternatively, the heat generation quantity of the second portion 508 of the sub-heater per unit area is set to be smaller than the heat generation quantity of the second portion 509 of the sub-heater per unit area. On the other hand, if the heat generation quantity of the signal processing circuits 506 is smaller than the heat generation quantity of the voltage generating circuits 507, heating by the second portion 509 of the sub-heater is not carried out. Alternatively, the heat generation quantity of the second portion 508 of the sub-heater per unit area is set to be greater than the heat generation quantity of the second portion 509 of the sub-heater per unit area. Through such control, a temperature distribution in the substrate 501 for the liquid ejecting head can be reduced. For example, a difference between the temperature of the area B1 and the temperature of the area B2 present when the currents are controlled as described above can be smaller than a difference between the temperature of the area B1 and the temperature of the area B2 present when the substrate 501 for the liquid ejecting head is operated without any power being supplied to the sub-heater.

The sub-heater can be controlled by controlling the magnitude of the voltage to be applied or the magnitude of the current. Alternatively, the sub-heater can be controlled by controlling duration in which a voltage is applied or a current is supplied. The magnitude of the voltage to be applied or of the current, and duration in which the voltage is applied or the current is supplied may both be controlled.

A first temperature sensor 510, a second temperature sensor 511, and a third temperature sensor 512 are disposed on the substrate 501 for the liquid ejecting head. The first temperature sensor 510 is disposed in the area A of the substrate 501 for the liquid ejecting head. The first temperature sensor 510 measures the temperature of the area A of the substrate 501 for the liquid ejecting head. The second temperature sensor 511 is disposed in the area B1 of the substrate 501 for the liquid ejecting head. The second temperature sensor 511 measures the temperature of the area B1 of the substrate 501 for the liquid ejecting head. The third temperature sensor 512 is disposed in the area B2 of the substrate 501 for the liquid ejecting head. The third temperature sensor 512 measures the temperature of the area B2 of the substrate 501 for the liquid ejecting head. A temperature sensor of which electrical characteristics vary in accordance with the temperature thereof, such as a diode and a resistor, may be used as the temperature sensors 510, 511, and 512.

The current supplied to the first portion 505 of the sub-heater, the current supplied to the second portion 508 of the sub-heater, and the current supplied to the second portion 509 of the sub-heater are controlled in accordance with the temperature information obtained by the first, second, and third temperature sensors 510, 511, and 512. The currents are controlled in a similar manner to the second exemplary embodiment. The temperature can be controlled with high precision by controlling the current to be supplied to the sub-heater in accordance with the temperature information of the respective areas obtained by the temperature sensors.

If the heat generation quantity of a functional circuit (including the signal processing circuits 506 and the voltage generating circuits 507) disposed in the area B1 or the area B2 is extremely large, or if such a functional circuit constantly radiates heat, the sub-heater does not need to be disposed in the area where that functional circuit is disposed. In other words, the second portion of the sub-heater may be disposed in only one of the area B1 and the area B2.

In the fifth exemplary embodiment as well, as in the third exemplary embodiment, the sub-heater may include a connecting portion that interconnects the first portion and the second portion of the sub-heater. In addition, in the fifth exemplary embodiment as well, as in the fourth exemplary embodiment, a connecting unit that controls an electrical connection between the first portion and the second portion of the sub-heater may be disposed.

Sixth Exemplary Embodiment

Another exemplary embodiment will be described. A sixth exemplary embodiment differs from the first exemplary embodiment in that a first portion and a second portion of a sub-heater are connected to each other. Hereinafter, only the features that differ from those of the first exemplary embodiment will be described, and descriptions of the features that are identical to those of the first exemplary embodiment will be omitted.

Figure 6:
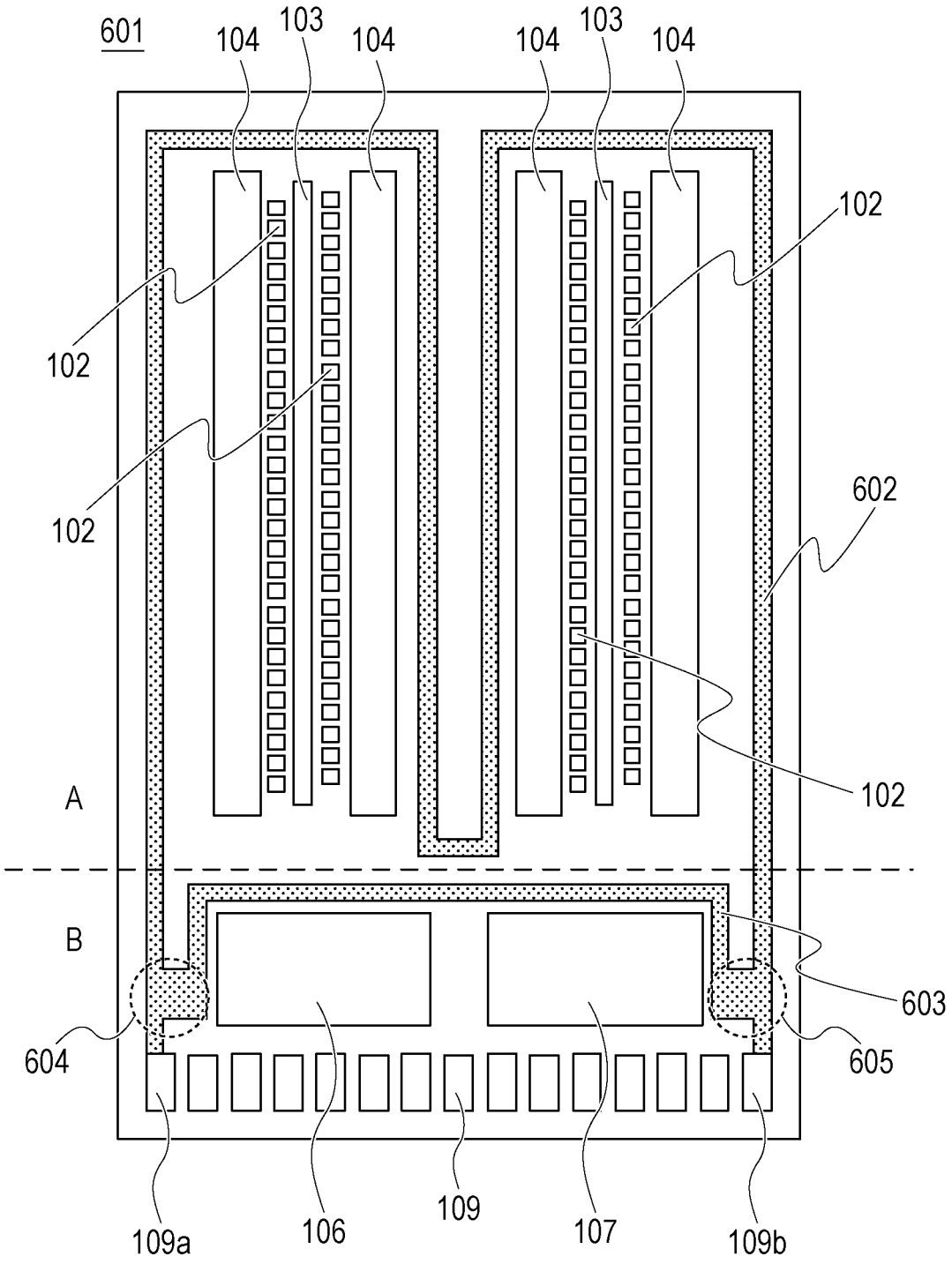
FIG. 6 schematically illustrates a planar configuration of a substrate for a liquid ejecting head.

FIG. 6 schematically illustrates a planar configuration of a substrate 601 for a liquid ejecting head. A component having a function identical to that of a corresponding component of the first exemplary embodiment is given an identical reference character, and detailed descriptions thereof will be omitted.

The sub-heater according to the sixth exemplary embodiment includes a first portion 602 and a second portion 603. The first portion 602 is disposed in the area A of the substrate 601 for the liquid ejecting head. The second portion 603 is disposed in the area B of the substrate 601 for the liquid ejecting head. In addition, the sub-heater includes two connecting portions 604 and 605. Each of the first portion 602 and the second portion 603 of the sub-heater connects the connecting portion 604 with the connecting portion 605. In other words, the first portion 602 and the second portion 603 of the sub-heater form parallel current paths.

The connecting portion 604 is connected to the first pad electrode 109*a*. The connecting portion 605 is connected to the second pad electrode 109*b*. A power supply voltage is inputted to the first pad electrode 109*a*. The second pad electrode 109*b* is grounded.

Here, wiring resistance of the first portion 602 is higher than wiring resistance of the second portion 603. For example, in a case in which the width and the thickness of the conductive member forming the sub-heater are constant, the wire length of the first portion 602 is greater than the wire length of the second portion 603.

The same voltage is applied to the first portion 602 and the second portion 603. Thus, the magnitudes of the currents flowing in the first portion 602 and the second portion 603 are determined on the basis of a ratio of the wiring resistance of the two. In the sixth exemplary embodiment, the wiring resistance of the first portion 602 is higher, and thus the magnitude of the current supplied to the first portion 602 is smaller than the magnitude of the current supplied to the second portion 603. Therefore, the heat generation quantity of the second portion 603 per unit area can be set to be greater than the heat generation quantity of the first portion 602 per unit area. Through such a configuration, a temperature distribution generated in the substrate 601 for the liquid ejecting head can be suppressed when the heat generation quantity of the signal supplying circuit is small.

It should be noted that the wiring resistance of the second portion 603 may be set to be higher than the wiring resistance of the first portion 602 by reducing the width of the second portion 603 or by using a material having high sheet resistance in the second portion 603. In such a case, the heat generation quantity of the first portion 602 per unit area can be set to be greater than the heat generation quantity of the second portion 603 per unit area. Through such a configuration, a temperature distribution generated in the substrate 601 for the liquid ejecting head can be suppressed when the heat generation quantity of the signal supplying circuit is large.

In the sixth exemplary embodiment, the magnitude of the current flowing in the first portion 602 and the magnitude of the current flowing in the second portion 603 may vary while the ratio therebetween stays constant. In this manner, the first portion 602 and the second portion 603 do not need to form mutually independent current paths.

In the above-described example, a case in which a power supply voltage is inputted to some of the pad electrodes and the remaining pad electrodes are grounded has been described. The voltages to be inputted to the pad electrodes, however, are not limited to the above example. Any two voltages that differ from each other may be inputted.

In addition, the substrate 601 for the liquid ejecting head may include temperature sensors as described in the second exemplary embodiment. In such a case, the currents are controlled in a manner similar to the second exemplary embodiment. In the sixth exemplary embodiment as well, as in the fourth exemplary embodiment, a connecting unit that controls an electrical connection between the first portion and the second portion of the sub-heater may be disposed.

As described thus far, in the sixth exemplary embodiment, the first portion and the second portion of the sub-heater are connected to each other. The magnitudes of the currents in the first portion and the second portion then differ from each other. Through such a configuration, the number of pad electrodes can be reduced. As a result, the size of the substrate for the liquid ejecting head can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-175725, filed Aug. 27, 2013, which is hereby incorporated by reference herein in its entirety.

What is claimed is:

1. A substrate for a liquid ejecting head, the substrate comprising:

a first area having a plurality of ejection heaters and a driving circuit disposed thereon, the driving circuit being configured to supply electric energy to the plurality of ejection heaters;

a second area having a signal supplying circuit disposed thereon, the signal supplying circuit being configured to supply an electric signal to the driving circuit; and a substrate heater configured to heat the substrate, the substrate heater including a first portion disposed in the first area and a second portion disposed in the second area, wherein a magnitude of a current supplied to the first portion differs from a magnitude of a current supplied to the second portion.

2. The substrate for the liquid ejecting head according to claim 1, wherein the first portion forms a first current path, and wherein the second portion forms a second current path that is independent from the first current path.

3. The substrate for the liquid ejecting head according to claim 1, further comprising:

first, second, third, and fourth pad electrodes configured to supply a current to the substrate heater, wherein the first portion connects the first pad electrode with the second pad electrode, and wherein the second portion connects the third pad electrode with the fourth pad electrode.

4. The substrate for the liquid ejecting head according to claim 3, wherein the first, second, third, and fourth pad electrodes are disposed at one side of the substrate for the liquid ejecting head.

5. The substrate for the liquid ejecting head according to claim 3, wherein the first and second pad electrodes are disposed, respectively, at first and second sides of the substrate for the liquid ejecting head, the first side being opposite to the second side, and wherein the third and fourth pad electrodes are disposed at the first side.

6. The substrate for the liquid ejecting head according to claim 1, further comprising:

a connecting unit configured to control an electrical connection between the first portion and the second portion.

7. The substrate for the liquid ejecting head according to claim 6, further comprising:

first, second, and third pad electrodes configured to supply a current to the substrate heater, wherein the connecting unit includes a first switch and a second switch, wherein the first portion connects the first switch with the first pad electrode, wherein the second portion connects the second switch with the second pad electrode, and wherein the substrate heater includes a third portion that connects the first switch, the second switch, and the third pad electrode to one another.

8. The substrate for the liquid ejecting head according to claim 7, wherein the first, second, and third pad electrodes are disposed at one side of the substrate for the liquid ejecting head.

9. The substrate for the liquid ejecting head according to claim 7, wherein the second and third pad electrodes are disposed at a first side of the substrate for the liquid ejecting head, and wherein the first pad electrode is disposed at a second side of the substrate for the liquid ejecting head, the second side being opposite to the first side.

10. The substrate for the liquid ejecting head according to claim 1, further comprising:

first, second, and third pad electrodes configured to supply a current to the substrate heater, wherein the substrate heater includes a connecting portion that connects the first portion with the second portion, wherein the first portion connects the connecting portion with the first pad electrode, wherein the second portion connects the connecting portion with the second pad electrode, wherein the substrate heater includes a third portion that connects the connecting portion with the third pad electrode, and wherein wiring resistance of the third portion is smaller than wiring resistance of the first portion and wiring resistance of the second portion.

11. The substrate for the liquid ejecting head according to claim 10, wherein the first, second, and third pad electrodes are disposed at one side of the substrate for the liquid ejecting head.

12. The substrate for the liquid ejecting head according to claim 10, wherein the second and third pad electrodes are disposed at a first side of the substrate for the liquid ejecting head, and wherein the first pad electrode is disposed at a second side of the substrate for the liquid ejecting head, the second side being opposite to the first side.

13. The substrate for the liquid ejecting head according to claim 1, wherein the first portion is disposed in a meandering manner across the first area.

14. The substrate for the liquid ejecting head according to claim 1, further comprising:

a first temperature sensor configured to measure a temperature of the first area; and a second temperature sensor configured to measure a temperature of the second area.

15. The substrate for the liquid ejecting head according to claim 14, wherein at least one of a current supplied to the first portion and a current supplied to the second portion is controlled on the basis of information on a temperature outputted from the first temperature sensor and information on a temperature outputted from the second temperature sensor.

16. The substrate for the liquid ejecting head according to claim 15, wherein at least one of the current supplied to the first portion and the current supplied to the second portion is controlled on the basis of a result of comparison between a reference temperature and each of the information on the temperature outputted from the first temperature sensor and the information on the temperature outputted from the second temperature sensor.

17. The substrate for the liquid ejecting head according to claim 14, wherein at least one of a current supplied to the first portion and a current supplied to the second portion is controlled on the basis of a result of comparison between information on a temperature outputted from the first temperature sensor and information on a temperature outputted from the second temperature sensor.

18. The substrate for the liquid ejecting head according to claim 1, wherein the electric signal supplied by the signal supplying circuit is one of a control signal of the driving circuit which is based on externally supplied information and a power supply voltage of the driving circuit.

19. The substrate for the liquid ejecting head according to claim 1, wherein the magnitude of the current supplied to the first portion differs from the magnitude of the current supplied to the second portion such that a difference between a temperature of the first area and a temperature of the second area is reduced as compared to a case in which the ejection heaters are operated without power being supplied to the substrate heater.

20. A liquid ejecting head, comprising:

the substrate for the liquid ejecting head according to claim 1; and an ink supplying unit configured to supply recording ink to the substrate for the liquid ejecting head.

21. A recording apparatus, comprising:

the liquid ejecting head according to claim 20; and a driving unit configured to drive the liquid ejecting head.

22. A substrate for a liquid ejecting head, the substrate comprising:

a first area having a plurality of ejection heaters and a driving circuit disposed thereon, the driving circuit being configured to supply electric energy to the plurality of ejection heaters;

a second area having a signal supplying circuit disposed thereon, the signal supplying circuit being configured to supply an electric signal to the driving circuit; and a heater configured to heat the substrate, the heater including a first portion disposed in the first area and a second portion disposed in the second area, wherein a heat generation quantity of the first portion per unit area differs from a heat generation quantity of the second portion per unit area.

23. A recording apparatus, comprising:

a substrate for a liquid ejecting head; and a controlling unit, wherein the substrate for the liquid ejecting head includes a first area having a plurality of ejection heaters and a driving circuit disposed thereon, the driving circuit being configured to supply electric energy to the plurality of ejection heaters, a second area having a signal supplying circuit disposed thereon, the signal supplying circuit being configured to supply an electric signal to the driving circuit, and a heater configured to heat the substrate, the heater including a first portion disposed in the first area and a second portion disposed in the second area, and wherein the controlling unit controls at least one of a current supplied to the first portion and a current supplied to the second portion independently from the other one of the current supplied to the first portion and the current supplied to the second portion.

* * * * *